United States Patent [19]

Hagemeyer

[11] Patent Number: 4,594,779

[45] Date of Patent: Jun. 17, 1986

[54] PUNCH AND DIE ADAPTER

[75] Inventor: Kenneth L. Hagemeyer, Rockford, Ill.

[73] Assignee: Ex-Cell-O Corporation, Troy, Mich.

[21] Appl. No.: 667,253

[22] Filed: Nov. 1, 1984

[51] Int. Cl.[4] ..... B26F 1/32

[52] U.S. Cl. ..... 30/360

[58] Field of Search ..... 30/360, 361, 362

[56] References Cited

U.S. PATENT DOCUMENTS

| | | | |
|---|---|---|---|
| 2,735,489 | 2/1956 | Fowler | 30/360 |
| 4,057,899 | 11/1977 | Ostendorf | 30/361 X |
| 4,403,417 | 9/1983 | Wilson et al. | 30/360 |

*Primary Examiner*—Donald R. Schran

*Attorney, Agent, or Firm*—Edward J. Timmer

[57] ABSTRACT

The adapter member includes a threaded male portion adapted for threadable engagement in a threaded bore of the punch and a threaded female portion of smaller diameter adapted for threadable engagement with a small diameter threaded end of the draw stud which can pass through an initial small diameter pilot hole in the workpiece. The adapter member allows the punch to accommodate a draw stud of sufficiently small diameter to fit through the pilot hole and allows punching of a larger diameter hole in light gage or non-ferrous materials without enlarging the pilot hole. This arrangement eliminated the need in the past for the additional step of enlarging the pilot hole to accept a draw stud of larger diameter that was threaded directly into the thread bore of the punch for punching larger diameter holes in both heavy and light gage material.

3 Claims, 3 Drawing Figures

PUNCH AND DIE ADAPTER

FIELD OF THE INVENTION

The invention relates to an adapter member for punches and dies to enable punching holes in material of various thickness with fewer steps.

BACKGROUND OF THE INVENTION

Larger diameter punches and dies designed to pierce heavier gage ferrous materials require a draw stud of sufficient diameter to withstand the tensile and bending forces imposed, the draw stud being that member which pulls the punch through the material toward and in cooperation with the die. A typical operation to pierce a 2-inch conduit hole would require the following steps. First, a pilot hole is drilled in the material to accept a draw stud of a first punch and die set. The first punch and die set is assembled relative to the material and a first hole is punched therein of a size (small diameter) to accept a larger draw stud of a second punch and die set. Then, the second punch and die set is assembled relative to the material with the larger diameter draw stud in the first punched hole. The second punch and die set punches the final 2-inch diameter conduit hole.

Although lighter gage and non-ferrous materials require less punching force than heavy gage ferrous materials, the same procedure was followed in the past to punch the same size hole therein.

SUMMARY OF THE INVENTION

It is an object of the invention to simplify the punching procedure in punching applications involving lighter gage and non-ferrous materials by eliminating the need to use a first punch and die set to enlarge the pilot hole to accept a larger diameter draw stud of a second punch and die set that forms the final size hole.

In a typical working embodiment of the invention, a punch and die set for punching a larger diameter hole includes an adapter member having a female threaded portion to accept a draw stud capable of fitting through the initial pilot hole and having a male threaded portion adapted to be threadably received in a punch capable of punching the larger diameter hole. The adapter member permits a larger diameter hole to be punched in lighter gage material without having to use a first punch and die set to enlarge the pilot hole; i.e., the invention eliminates one complete step required in the past to punch a larger diameter hole in light gage or non-ferrous materials.

In a preferred embodiment of the invention, the punch and die set also includes a draw stud having a driven end a diameter substantially equal to the diameter of the draw stud used to punch heavier gage material and a working end of smaller diameter adapted to be threadably received in the threaded female portion of the adapter member and also adapted to pass through the pilot hole. A common driver can mate with the draw stud for punching heavy or light gage material. The set also includes a spacer member having a side adapted to abut the die and a central bore of a diameter capable of receiving the driven end of the draw stud. The spacer member provides end limit position for the die during punching of smaller diameter holes in material of all rated gages.

DESCRIPTION OF PREFERRED EMBODIMENTS

Figure 1:
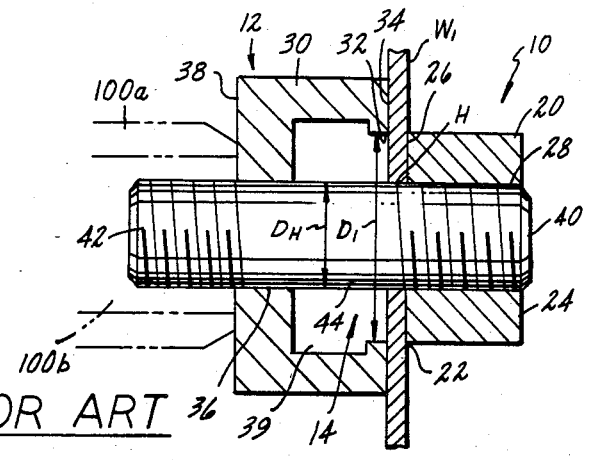
FIG. 1 PRIOR ART
FIG. 1 is a longitudinal sectional view of a prior art punch and die set for punching a larger diameter hole in heavy gage material.

FIG. 1 illustrates a typical prior art punch and die set for punching a hole of large diameter $D_1$ in relatively heavy gage material $W_1$. The punch and die set includes a punch 10, die 12 and draw stud 14 with punch 10 abutted against one side of workpiece $W_1$ and die 12 abuttable against the other side in opposition to the punch as shown. The punch 10 includes a cylindrical or other shaped body 20 having an outer cutting profile 22 of a diameter substantially equal to the diameter $D_1$, a free end 24, an abutted end 26 against the side of the workpiece and a longitudinal or axial threaded bore 28. The die 12 includes a hollow body 30 having an inner annular cutting surface 32 on an abutted end 34 against the workpiece, a longitudinal or axial bore 36, free end 38 which abuts with the driver, and an interior chamber 39 to receive the annular disc of material (not shown) punched out of the workpiece. The longitudinal bore 36 of the die is coaxial with the threaded bore 28 of the punch.

Extending between the punch and die is draw stud 14 having a threaded end 40 threadably engaged in threaded bore 28 of the punch and an opposite threaded end 42 extending out of the die for driving engagement by a known driver having a stationary member **100*a* and moveable member 100*b* such as a driver Model 7804 available from Greenlee Tool Division, Ex-Cell-O Corporation, 2330 23rd Avenue, Rockford, Ill. 61101. Intermediate threaded ends 40,42 is a cylindrical shaft portion 44 of a diameter to pass through hole H formed in the workpiece by first drilling a small diameter pilot hole and then enlarging the pilot hole to the diameter shown by an extra punching operation with an intermediate size first punch and die assembly as described hereinabove in the Background of the Invention section. When the driver pulls the draw stud to the left in FIG. 1, punch 10 is pulled toward the die and cuts the workpiece as the punch is drawn into the die with cutting surfaces 22,32** cooperating to shear the material as is well known.

For punching heavy gage material, the diameter of the draw stud must be sufficient to withstand the high tensile forces and bending forces present. In FIG. 1, the diameter of draw stud 14 is selected as $D_H$.

Figure 2:
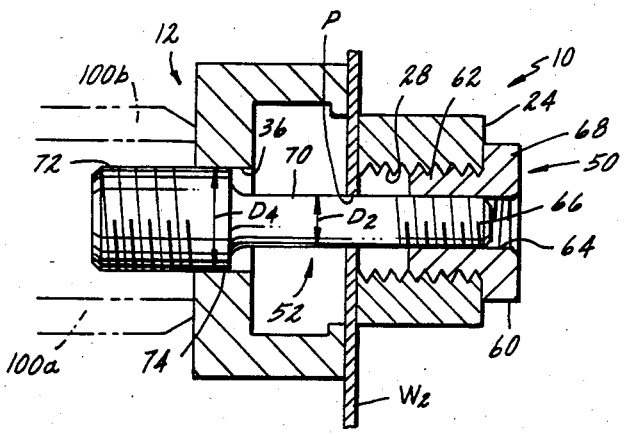
FIG. 2 is a longitudinal sectional view of a punch and die set of the invention for punching a larger diameter hole in light gage or non-ferrous materials.

FIG. 2 shows the punch and die set of the invention for punching a hole in lighter gage workpiece $W_2$ of the same diameter $D_1$ as described for FIG. 1, the difference being the lighter gage of workpiece $W_2$. As shown in FIG. 2, the punch 10 and die 12 are identical to the punch and die of FIG. 1 and carry the same reference numerals. However, the punch and die set of the invention include a novel adapter member 50 and draw stud 52 to permit the same diameter ($D_1$) hole to be punched into the light gage material but without the requirement of enlarging the pilot hole P by an extra punching step using the intermediate first punch and die set as described hereinabove in the Background of the Invention section.

It is apparent that the adapter member 50 comprises a body 60 having a threaded cylindrical-shaped male surface or portion 62 of a diameter to be threadably received in the threaded longitudinal bore 28 of the punch and having an inner threaded bore or female portion 64 of a diameter to threadably receive the threaded end 66 of the draw stud. The adapter member may also include an annular shoulder 68 extending radially or transversely in overlapping abutting relation to the free end 24 of the punch.

The draw stud 52 includes the aforementioned threaded end 66 and intermediate cylindrical shaft portion 70, both of a diameter to pass through the initial pilot hole P drilled in workpiece $W_2$ and having a diameter $D_2$ smaller than the diameter of hole H and draw stud 14 of FIG. 1. Pilot hole P would correspond to that initially drilled in the workpiece $W_1$ and then enlarged by the extra intermediate punching operation to accept draw stud 14. By providing draw stud 52 with threaded end 66 and shaft portion 70 of the smaller diameter to pass through the pilot hole, the second intermediate punching operation is eliminated for light gage workpiece $W_2$ because the smaller diameter draw stud 52 can withstand the correspondingly smaller tensile forces and bending forces associated with punching the lighter gage material or non-ferrous material.

The end of draw stud 52 opposite threaded end 66 comprises a threaded end 72 and cylindrical shoulder 74, both of the diameters $D_4$ substantially equal to the diameter $D_H$ of draw stud 14 of FIG. 1. It is apparent that shoulder 74 can thus pass through longitudinal bore 36 of die 12 in the same manner as draw stud 14 and that threaded end 72 can be driven by the same driver as driven end 42 of draw stud 14.

Once the punch, die, adapter member and draw stud are assembled in working relation as shown, the driver is actuated to pull the draw stud 52 to the left and thus to cause punch 10 to be pulled into die 12 so as to cut the hole of diameter $D_1$ in the lighter gage workpiece $W_2$. Importantly, prior to actual punching of the hole of diameter $D_1$ in the workpiece $W_2$, only pilot hole P needs to be formed because draw stud 52 can pass therethrough as shown. Enlargement of pilot hole P is not required as in the prior art punching operations of light gage material using the punch and die set of FIG. 1.

Figure 3:
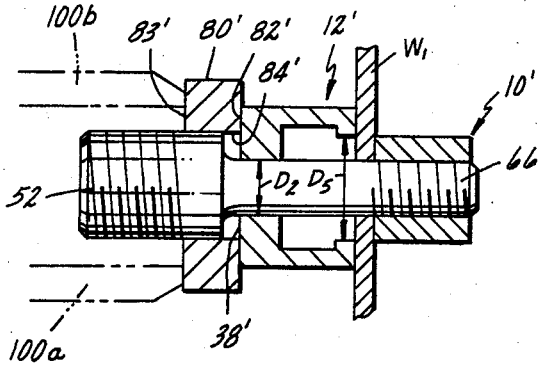
FIG. 3 is a longitudinal sectional view of the punch and die set without the adapter member but with a spacer member for punching a smaller diameter hole in light or heavy gage material.

FIG. 3 illustrates the punching of a hole of smaller diameter $D_5$ in heavy gage material $W_1$ wherein draw stud 52 is used in combination with punch 10' and die 12' which have similar features as punch 10 and die 12 described above but which are smaller in size than the punch 10 and die 12 of FIGS. 1 and 2. The draw stud 52 is identical to that of FIG. 2 and is used in combination with an annular spacer member 80' having an abutted end 82' abutted against free end 38' of die 12' and an opposite end 83' to abut with the driver, and further having a longitudinal bore 84' of a diameter to receive cylindrical shoulder 74 of draw stud 52. The spacer provides a longitudinal or axial limit position of the die 12' which is supported on diameter $D_2$ of the stud. Otherwise, the operation of the punch 10', die 12', and draw stud 52 are the same as described hereinabove for FIGS. 1 and 2. The assembly of FIG. 3 can also be used for punching lighter gage material as well. The draw stud 52 thus is usable with other punch and die sets.

Although certain preferred features and embodiments of the invention have been described hereinabove and illustrated in the Figures, it is to be understood that modifications and changes may be made therein without departing from the spirit and scope of the invention as defined in the appended claims.

We claim:

1. In combination a draw stud and adapter member for use in punching a hole in material having a small pilot hole therein with a punch and die wherein the punch includes a threaded longitudinal bore of selected diameter adapted to receive a large diameter draw stud unable to pass through the small pilot hole and the die includes a coaxial longitudinal bore adapted to receive the large diameter draw stud, said adapter member having a threaded male portion with a diameter substantially the same as the selected diameter of the threaded longitudinal bore of the punch for threadable engagement in said threaded longitudinal bore and a threaded female portion having a smaller diameter than said selected diameter of said threaded longitudinal bore and said draw stud having a threaded end portion with substantially said smaller diameter adapted for passing through the small pilot hole and for threadable engagement in said threaded female portion and another end portion receivable in said longitudinal bore of said die, said adapter member and draw stud being removable by unthreading from the punch to enable a draw stud of the large diameter to be used with the same punch and die.

2. The combination of claim 1 wherein said another end of said draw stud includes a threaded end portion having said selected diameter of said threaded longitudinal bore and a cylindrical portion inboard of said threaded end receivable in said longitudinal bore of said die.

3. The combination of claim 1 wherein the adapter member further includes a shoulder extending transversely in overlapping relation to an end of said punch.

* * * * *